US010040667B2

(12) United States Patent
Roivainen et al.

(10) Patent No.: US 10,040,667 B2
(45) Date of Patent: Aug. 7, 2018

(54) ELEVATOR CAR

(71) Applicants: Gabriela Roivainen, Hyvinkaeae (FI); Iiro Heinonen, Hyvinkaeae (FI)

(72) Inventors: Gabriela Roivainen, Hyvinkaeae (FI); Iiro Heinonen, Hyvinkaeae (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 14/940,646

(22) Filed: Nov. 13, 2015

(65) Prior Publication Data

US 2016/0167924 A1 Jun. 16, 2016

(30) Foreign Application Priority Data

Dec. 11, 2014 (EP) ..... 14197401

(51) Int. Cl.
*B66B 11/02* (2006.01)

(52) U.S. Cl.
CPC ..... *B66B 11/0226* (2013.01); *B66B 11/0213* (2013.01)

(58) Field of Classification Search
CPC ..... B66B 11/0226; B66B 11/0213
USPC ..... 187/401
See application file for complete search history.

(56) References Cited

U.S. PATENT DOCUMENTS 3,945,468 A * 3/1976 Miura ..... B66B 11/0226 187/401
4,723,627 A * 2/1988 Ito ..... B66B 11/0226 187/401
5,018,602 A * 5/1991 Salmon ..... B66B 11/026 187/401
5,220,979 A * 6/1993 Matsuda ..... B66B 11/0226 187/401
5,251,726 A * 10/1993 de Jong ..... B66B 13/285 187/401
5,564,529 A * 10/1996 Ericson ..... B66B 11/0206 187/401
6,119,815 A * 9/2000 Ziegler ..... B66F 17/00 187/269
6,318,509 B1 * 11/2001 Spieler ..... B66B 11/0226 187/401
6,615,952 B2 * 9/2003 Itoh ..... B66B 11/0095 187/249

(Continued)

FOREIGN PATENT DOCUMENTS

EP 1129978 A2 9/2001
JP H1179612 A 3/1999

(Continued)

*Primary Examiner* — Michael A Riegelman
(74) *Attorney, Agent, or Firm* — Harness, Dickey & Pierce, P.L.C.

(57) ABSTRACT

Example embodiments relate to an elevator car, including a car spoiler at its top and/or bottom thereof, a car sling with a horizontal frame part on which at least one elevator cabin is supported, and at least one vertically extending spoiler element is located aside of the horizontal frame part. The spoiler element may have upper and lower flange portions, at least one of the upper and lower flanges being connected with elevator car parts located above and/or below of the frame part, and a vertically extending middle portion. The spoiler element may be arranged a distance from the frame part. An elevator car having this arrangement may reduce noise and provide better efficiency.

16 Claims, 4 Drawing Sheets

(56) References Cited

U.S. PATENT DOCUMENTS

| | | | | |
|---|---|---|---|---|
| 7,077,240 | B2 * | 7/2006 | Itoh | B66B 11/0095 187/249 |
| 7,287,624 | B2 * | 10/2007 | Itoh | B66B 11/0095 187/249 |
| 2001/0018996 | A1 | 9/2001 | Itoh et al. | |
| 2004/0016605 | A1 | 1/2004 | Itoh et al. | |
| 2004/0094369 | A1 | 5/2004 | Itoh et al. | |
| 2006/0289242 | A1 * | 12/2006 | Oberer | B66B 13/285 187/333 |
| 2010/0116597 | A1 * | 5/2010 | Matsuda | B66B 11/028 187/401 |
| 2013/0098713 | A1 | 4/2013 | Urben et al. | |
| 2016/0167925 | A1 * | 6/2016 | Roivainen | B66B 11/0226 187/401 |

FOREIGN PATENT DOCUMENTS

| | | | | |
|---|---|---|---|---|
| JP | 2002179368 | A | * | 6/2002 |
| WO | WO-2011138178 | A1 | | 11/2011 |
| WO | WO-2013186890 | A1 | | 12/2013 |

* cited by examiner

ELEVATOR CAR

This application claims priority to European Patent Application No. EP14197401.4 filed on Dec. 11, 2014, the entire contents of which are incorporated herein by reference.

Example embodiments relate to an elevator car comprising a car spoiler at its top and/or bottom thereof. Particularly for high rise elevators having elevator cars traveling with fast speed, car spoilers at the top and/or bottom of the elevator car, preferably at both sides, have revealed advantageous with respect to the noise generation and the efficiency of the elevator.

Example embodiments further provide an elevator car having reduced noise level for better passenger comfort and increased efficiency.

According to an example embodiment, the elevator car has a car sling with a horizontal frame part which is usually a sling platform but also may be a frame or beam construction extending in horizontal direction and configured to support the cabin. The elevator car has furthermore at least one vertically extending spoiler element located aside of the frame part which spoiler element has upper and lower flange portions while at least one of them being connected with the elevator car parts located above and/or below of the frame part. The spoiler element further has an essentially vertically extending middle portion particularly the middle portion between the upper and lower flange portion which clads the elevator car at the level of the horizontal frame part. The spoiler element is arranged in a distance from the frame part. Via this solution, the spoiler element is acoustically decoupled from the horizontal frame part of the car sling and thus from the car sling in total. The car sling is generally suspended via hoisting ropes regularly on a traction sheave of an elevator drive machine and is guided with rollers along the guide rails mounted in the elevator shaft. During the drive of the elevator car vibrations induced by the hoisting ropes or guide rollers are directly promoted to the car sling. By acoustically decoupling the spoiler element from the car sling it is ensured that these vibrations to which the car sling is subjected are not transmitted to the cabin or the spoiler elements cladding the elevator car.

In an example embodiment, the spoiler element and other spoiler components of the elevator car are connected with fixings and screws to each other and to the elevator car, preferably from the inner side facing the elevator car. The fixing between the top spoiler and the C profiles located on the roof of the car is preferably done with brackets and T-bolts. The fixing between the parts of the spoilers is preferably done with screws and rivet nuts.

The middle portion of the spoiler element is preferably offset with respect to at least one of said flange portions away from the elevator car. Of course the spoiler element with its upper flange portion, its lower flange portion and the middle portion in between could be realized via a simple plate but this would require the horizontal frame portion of the car sling to be narrower than the width of the cabin as to allow the mounting of the spoiler element without touching the horizontal frame part. The offset of a middle portion of the spoiler element away from the elevator car enables the horizontal frame portion to be made with the same width as the elevator cabin, without the spoiler element touching it. In other words the horizontal frame part may extend laterally to the cabin walls or spoiler plates of the cabin walls. Therefore, the horizontal frame part does not have to have a reduced horizontal dimension to be in a distance from the spoiler element. Of course, the spoiler element can simply be a plate where the upper and lower flange portion and the middle portion are in one plane if the horizontal frame part of the car sling has reduced lateral dimensions which do not reach to the outer boundaries of the elevator cabin.

When the spoiler element is mounted to an elevator car having a single cabin, then the horizontal frame part is usually located at the bottom of the cabin and the cabin is supported on the horizontal frame part of the car sling via spring means and/or dampening means. Via this measure, the cabin is acoustically decoupled from the car sling. In this case, the spoiler element is with its upper flange portion preferably fixed to the cabin via the bottom, a sidewall or via a spoiler plate located aside of the elevator cabin, whereby its lower flange portion abuts against a bottom car spoiler which has regularly a curved shape as to minimize air resistance.

If the horizontal frame part of the car sling for supporting the cabin is located in the top of a single cabin, then the spoiler element is preferably fixed with its lower flange portion to a sidewall of the elevator cabin or to a spoiler plate which is located aside of the cabin and with its upper flange portion to a top car spoiler.

With these two alternative mounting options, the top car spoiler or bottom car spoiler is mounted to the cabin of the elevator car which is acoustically decoupled from the car sling. By the fact that the spoiler element is arranged in a horizontal distance from the horizontal frame part of the car sling, it is ensured that also the spoiler parts of the elevator car are acoustically decoupled from the car sling which reduces the general noise level of the elevator car even during fast speed travel.

Although it is possible to provide the middle portion of the vertically extending spoiler element with a curved shape as to circumvent around the horizontal frame part of the car sling, it is preferable for manufacture and cost reasons that the middle portion is flat.

In a further example embodiment, the spoiler element comprises two inclined connecting portions between the upper/lower flange portions and the middle portion which connecting portions are inclined with respect to the vertical direction about 10 to 45 degrees, particularly between 10 and 30 degrees. Such a spoiler element can be easily manufactured for example by bending a metal sheet so that it has upper and lower flange portions and a middle portion which extend essentially vertically and the connecting portions which are inclined within the above-mentioned range. The machining of such a spoiler element is really simple, while the shape is useful to avoid turbulences in the gap between the elevator car and the shaft wall during travel of the elevator car.

In an example embodiment, above and below the spoiler element are other spoiler parts of the elevator car and the spoiler element is connected with at least one flange portion to at least one of these spoiler parts. In this case, the other one of the flange portions only butts against the another of the spoiler parts but is not fixed to it. This arrangement allows a mutual movement of the spoiler parts above and below the spoiler element, for example in vertical direction, which may happen if, for example, the elevator cabin is supported via spring and/or dampening means on the horizontal frame part whereas the top or bottom car spoiler are mounted directly to the frame part or any other part of the car sling. In this case, a relative movement occurs between the cabin and the corresponding spoiler part of the elevator car. This mutual movement is possible as the spoiler element has only one flange portion fixed to the cabin or spoiler part while the other flange portion only abuts against the other component.

In a further example embodiment, directed to a double deck elevator, the elevator car has two elevator cabins placed one above each other. In this case, only one of the upper or lower flange portions of the spoiler element is connected to the upper or lower cabin, whereas the other flange portion of the spoiler element butts against a part of the other cabin. The reason for this embodiment is that usually both cabins are supported via their own spring and/or dampening means to the car sling so that mutual movements between the two cabins may happen. By fixing the spoiler element only to one of these cabins, the mutual movement of the cabins is still possible and on the other hand, the spoiler element closes the gap between the two cabins wherein the horizontal frame part of the car sling is located. By this measure, the horizontal frame part is effectively cladded by the spoiler element so that the noise reduction also in this difficult part of the elevator car is easily realized.

In an example embodiment, only the upper flange portion of the spoiler element is connected to the upper cabin, particularly to the cabin floor or to the side edge of the cabin floor, whereas the lower flange portion butts against a side wall or lining plate or spoiler plate of the lower cabin. This arrangement clads the vertical level of the horizontal frame part effectively with the spoiler element without hampering the mutual movement of the two cabins.

As it is mentioned above, the at least one elevator cabin of the elevator car is preferably mounted via spring means and/or dampening means to the horizontal frame part of the cycling. Via this spring—and/or dampening means which may include screw springs, rubber dampening means or other corresponding elements, the noise and vibrations which are transferred to the car sling are not transmitted to the elevator cabin so that a higher level of passenger comfort is obtained.

Although the horizontal frame part of the car sling may only be realized as a rectangular box frame or a horizontal beam it also may be embodied as a sling platform to which the elevator cabin is mounted.

In a further example embodiment, the upper and lower flange portions of the spoiler element extend vertically so that they can easily be mounted to other vertically extending parts of the elevator car above and below the spoiler element.

In a further example embodiment, the elevator car is cladded at least on one side of the elevator cabin with a vertically extending spoiler plate. The spoiler plate connected to the upper and lower car spoilers essentially reduces turbulences aside of the elevator car and leads to a better passing of the air which is guided by the upper and lower car spoilers to the gaps between the elevator car and the shaft walls. In a preferred embodiment, the spoiler element is then connected to at least one of said spoiler plates cladding at least one side, preferably all sides of the elevator cabin.

In a further example embodiment, the spoiler element is made from a sheet metal plate which is easy to manufacture and which is the most simple element to perform a cladding of the elevator car in the area of the horizontal frame part of the car sling.

It should be appreciated that if an elevator car has several elevator cabins located one above each other, such a spoiler element can be located at every horizontal frame part of the car sling.

Example embodiments are also directed to an elevator comprising at least one elevator car according to the above specifications.

It shall be clear that each component of example embodiments may be provided as a single component or as multiple components. Therefore, the spoiler element can be provided as one spoiler element plate at one side of the elevator car but it also may consist of several spoiler element plates located aside of each other. Furthermore, the spoiler element can also consist of two or several vertical members which are mounted to each other as to form the spoiler element cladding the horizontal frame part, e.g., sling platform of the car sling.

Some inventive embodiments are also discussed in the description and drawings of the present application. The inventive content may also consist of several separate inventions, especially if the invention is considered in the light of expressions or implicit subtasks or from the point of view of advantages achieved. In this case, some of the attributes contained in the claims below may be superfluous from the point of view of separate inventive concepts. The features of the various embodiments can be applied within the scope of the basic inventive concept in conjunction with other embodiments.

BRIEF DESCRIPTION OF THE DRAWINGS

The invention is hereinafter described schematically with respect to the enclosed drawings.

DETAILED DESCRIPTION OF EXAMPLE EMBODIMENTS

Figure 1:
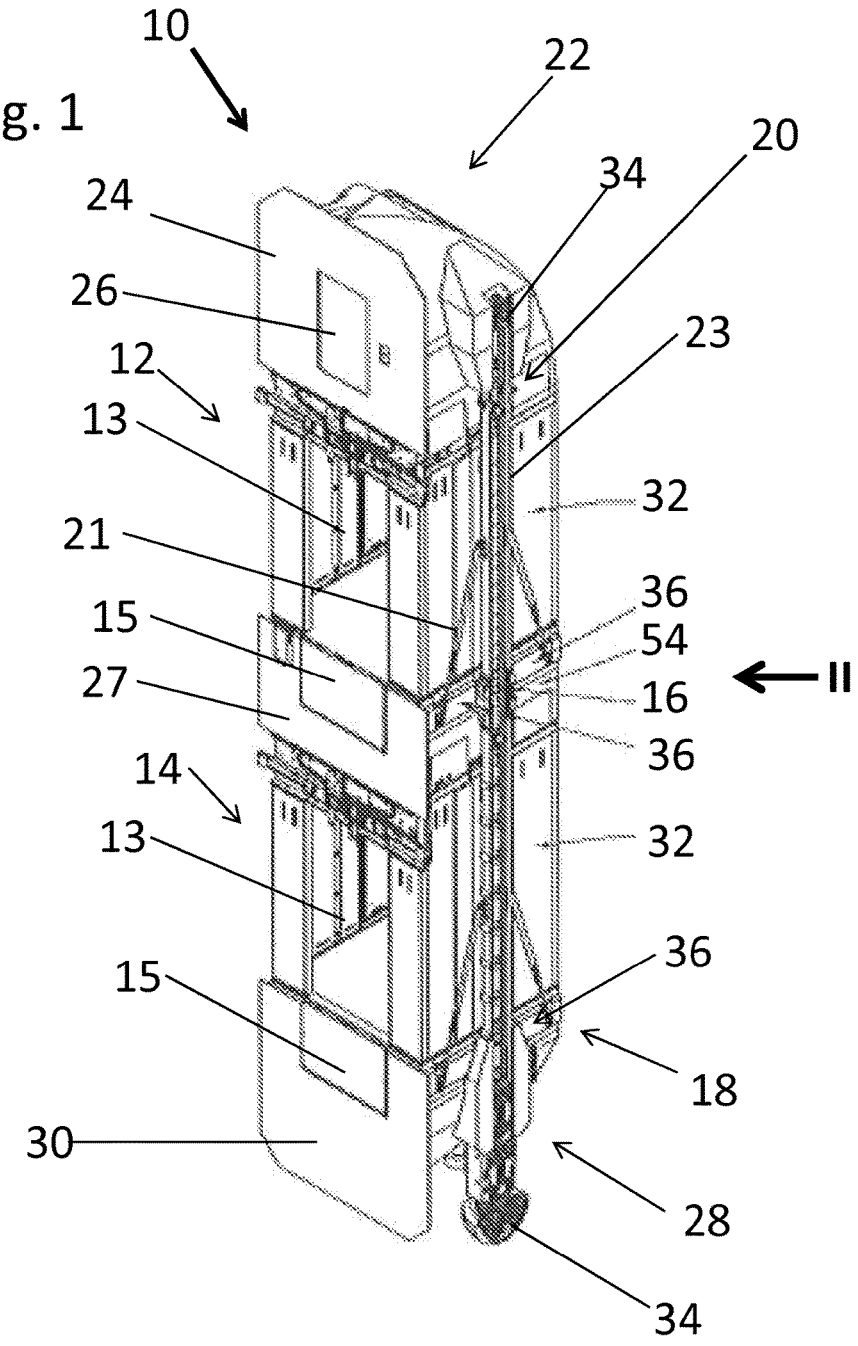
FIG. 1 shows a perspective view of an elevator car having two cabins placed one above each other.

FIG. 1 shows an elevator car 10 having an upper cabin 12 and a lower cabin 14 which are suspended on an upper sling platform 16 and a lower sling platform 18 of a car sling 20. Both cabins have door openings 13 in which usually telescopic slide doors are provided. On top of the upper cabin 12, an upper car spoiler 22 is located which has on the door side of the cabins 12, 14 a spoiler plate 24 having a hatch 26 to obtain access to the roof of the upper cabin 12 for maintenance purposes.

Figure 2:
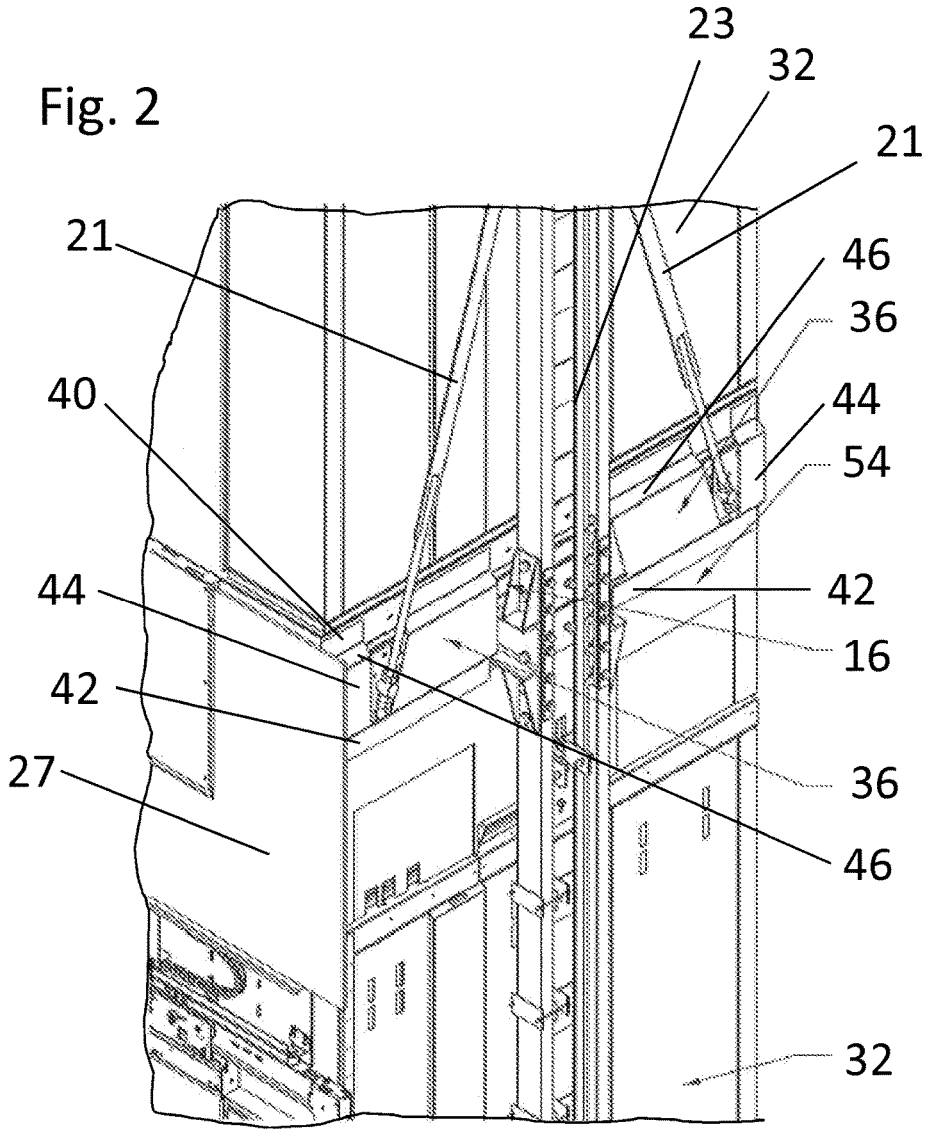
FIG. 2 shows a perspective view of the detail II from FIG. 1.
Figure 3:
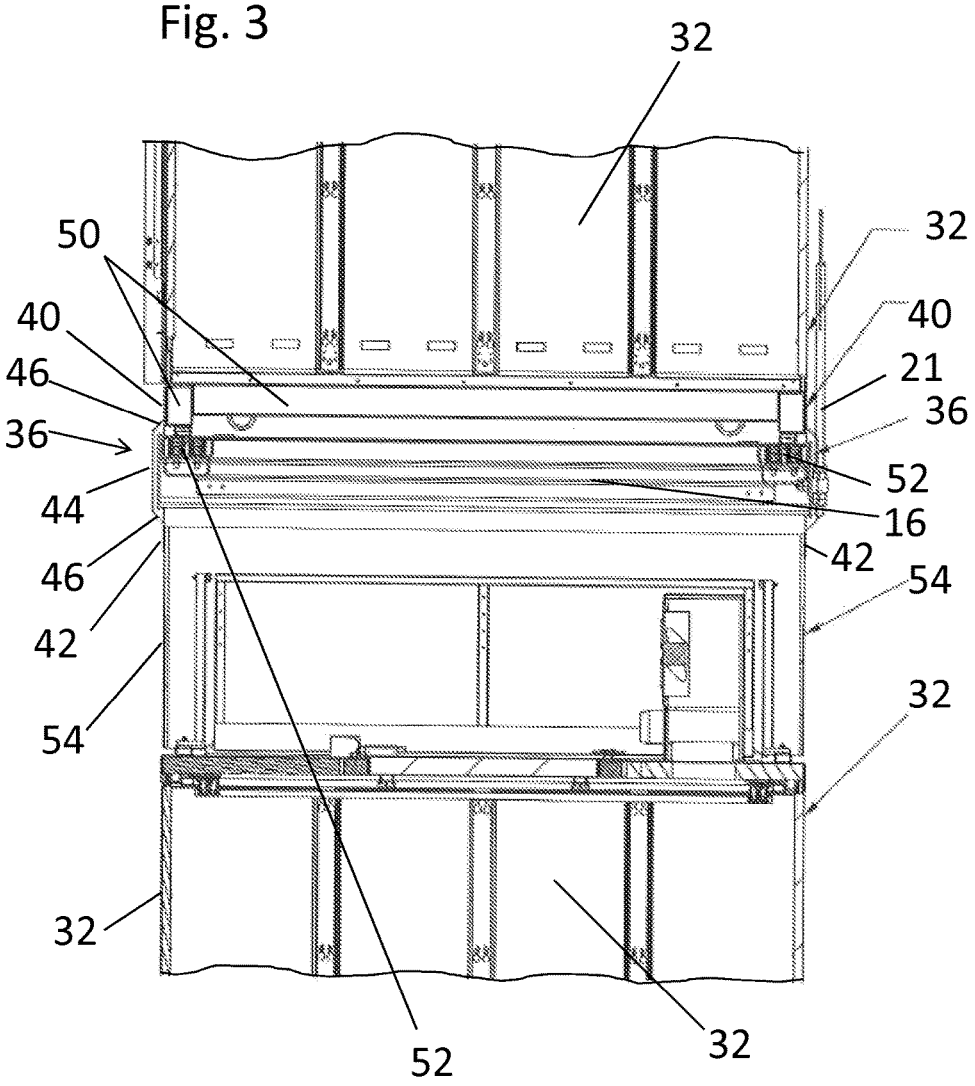
FIG. 3 shows a side view of the detail II of FIG. 1.
Figure 4:
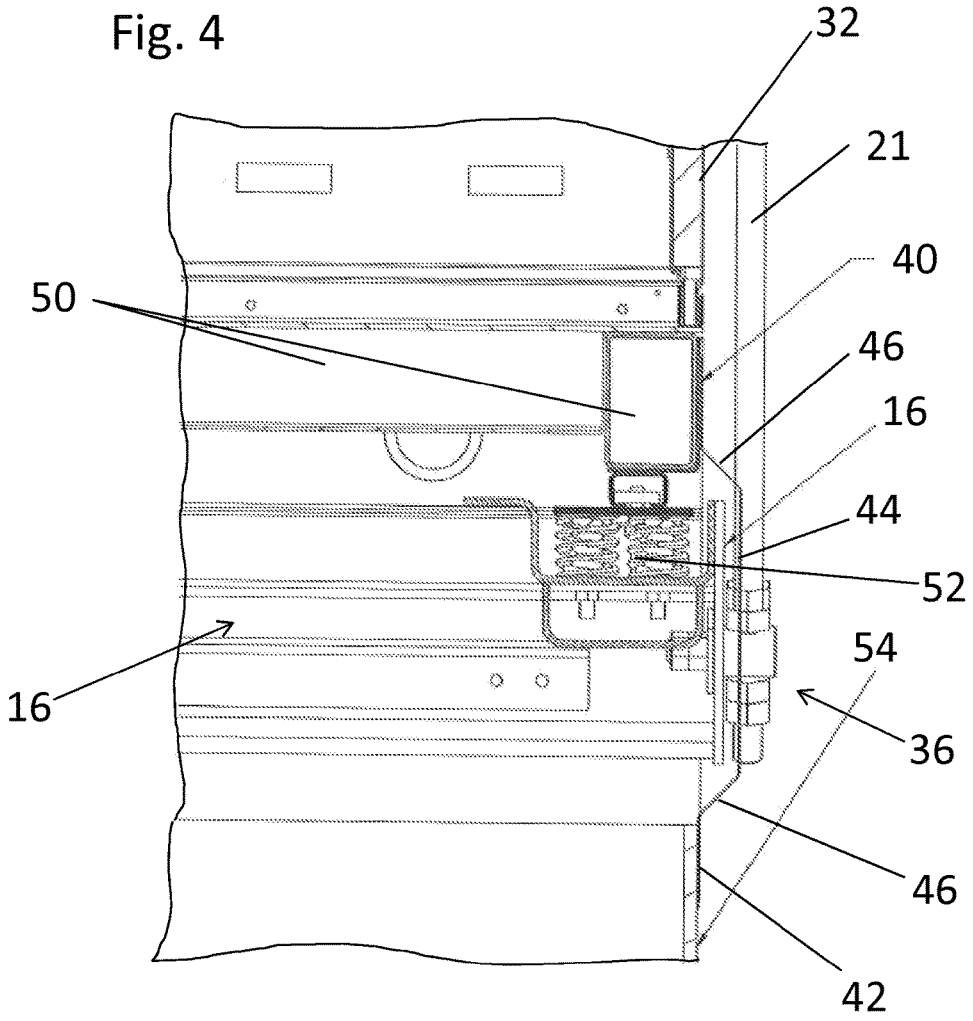
FIG. 4 shows an enlarged cross-sectional view of the detail II of FIG. 1.

The elevator car 10 also comprises a lower car spoiler 28 which has a lower spoiler plate 30 below the lower cabin 14 comprising a hatch 15 for getting maintenance access for the space between the bottom car spoiler 28 and the floor of the lower cabin 14. On the sides of the elevator cabins 12, 14, spoiler plates 32 are arranged to provide a cladding of the elevator car 10 also on its lateral sides so as to provide a reduced air resistance and reduced turbulences between the car sides and a surrounding elevator shaft wall. The upper and lower sling platform 16, 18 are stabilized at the car sling 20 via support arms 21 extending to both sides of vertical part 23 of the car sling 20. The car sling 20 also comprises guide rollers and gripping elements 34 on the top and bottom of the vertical part 23 of the car sling 20 via which the elevator car 10 is guided along guide rails provided in an elevator shaft. The car comprises in the top also a fixing for the hoisting ropes of the elevator (not shown) via which the elevator car is suspended in an elevator shaft, preferably running via a traction sheave of an elevator drive machine unit. The upper and lower sling platform 16, 18 are cladded via spoiler elements 36 located side by side which can better be seen in a perspective view of the detail II from FIG. 1 shown in FIG. 2, in the side view of FIG. 3 and in the sectional view of said detail according to FIG. 4.

The spoiler elements 36 have an upper flange portion 40, a lower flange portion 42 and a middle portion 44 which all extend vertically. It is clear that the spoiler element is intended to extend essentially vertically to cover the region of the horizontal frame part or sling platform of the car sling but it may also be tilted with respect to a vertical in a certain range, for example +/−20 degrees, particularly if it has curved portions.

The upper and lower flange parts 40, 42 and the middle portion 44 are connected with each other via connecting portions 46 which are tilted with respect to the vertical upper and lower flange portions 40, 42 and the middle portion 44 within an area of preferably 10 to 45 degrees. The upper flange portion 40 of the spoiler element 36 is fixed to the cabin floor 50 of the upper cabin 12 which is supported via a spring and/or dampening means 52 on the sling platform 16. The lower flange portion 42 of the spoiler element 36 butts against an upper intermediate spoiler plate 54 of the lower cabin 14 which surrounds the top of the lower cabin to enable maintenance persons to provide maintenance work there on elevator components, as for example the door operator. On the car door side the top of the lower cabin is cladded by an intermediate front spoiler plate 27 comprising a hatch 15 to enable access to the roof of the lower cabin 14. Via the spoiler elements 36, the area around the sling platform 16 is cladded without coming into contact with the sling platform 16 itself so that noise which is transmitted to the car sling via the guide rollers and the hoisting ropes is kept away from the cabins and the spoiler parts of the elevator car.

The fact that the lower flange portion 42 only abuts against the upper intermediate spoiler plate 54 of the lower cabin 14 has the advantage that mutual movements between the upper cabin 12 and the lower cabin 14 are possible which are supported with their own spring and dampening means 52 on the corresponding sling platforms 16, 18. It is needless to say that the sling platform 16, 18 does not need to be embodied as a sling platform but it can be realized as a horizontal beam or horizontal rectangular supporting structure.

Also the lower sling platform 18 is cladded by the spoiler elements 36 described above, whereby their upper flange is fixed to the floor of the lower cabin 14 and the lower flange abuts against the lower car spoiler 28.

It shall further be clear that the invention is not restricted to the above-mentioned embodiments but may be varied within the scope of the appended patent claims.

What is claimed is:

1. An elevator car having side portions, a top portion and a bottom portion, the elevator car comprising:

a spoiler on at least one of the top portion and the bottom portion of the elevator car, a car sling with a horizontal frame part on which the elevator car is supported thereon, and a plurality of spoiler elements on a first side of the side portions of the elevator car, at least one of the spoiler elements covering at least a first part of the horizontal frame part, the first side not being one of the side portions of the elevator car with elevator doors, the spoiler elements being arranged side by side with respect to each other, each of the spoiler elements including an upper flange portion, connecting portions, and a lower flange portion, the connecting portions including a first connecting portion and a second connecting portion, the first connecting portion connected to the upper flange portion, the second connecting portion connected to the lower flange portion, wherein at least one of the upper flange portion and the lower flange portion is connected with the elevator car located above and/or below the horizontal frame part, the connecting portions are between the upper flange portion and the lower flange portion, and the connecting portions are tilted away from the first side of the elevator car such that an upper portion of the first connecting portion is closer to the first side of the elevator car than a lower portion of the first connecting portion and a lower portion of the second connecting portion is closer to the first side of the elevator car than an upper portion of the second connecting portion.

2. The elevator car according to claim 1, wherein the spoiler elements include a flat middle portion.

3. The elevator car according to claim 1, wherein connecting portions are tilted with respect to a vertical direction of about 10 to 45 degrees away from the first side of the elevator car.

4. The elevator car according to claim 1, wherein the spoiler of the elevator car is located at least one of above and below the spoiler elements, and the spoiler elements are connected to the spoiler.

5. The elevator car according to claim 1, wherein the elevator car is above or below another elevator car, only one of the upper flange portion and the lower flange portion of the spoiler elements is connected to one of the elevator car and the another elevator car, and one of the upper flange portion and the lower flange portion abuts against a part of one of the elevator car and the another elevator car.

6. The elevator car according to claim 5, wherein only the upper flange portion of the spoiler elements is connected to an upper one of the elevator car and the another elevator car, and the lower flange portion abuts against at least one of the side portions and a spoiler plate of a lower one of the elevator car and the another elevator car.

7. The elevator car according to claim 1, wherein the elevator car is supported on the horizontal frame part via a spring device.

8. The elevator car according to claim 1, wherein the horizontal frame part is a sling platform.

9. The elevator car according to claim 1, wherein the upper flange portion and the lower flange portion of the spoiler elements extend vertically.

10. The elevator car according to claim 9, wherein the upper flange portion and the lower flange portion of the spoiler elements are flat.

11. The elevator car according to claim 1, wherein the elevator car is cladded at least on one of the side portions of the elevator car with a vertically extending spoiler plate.

12. The elevator car according to claim 11, wherein the spoiler elements are connected to the spoiler plate.

13. The elevator car according to claim 1, wherein the spoiler elements are made from a sheet metal plate.

14. The elevator car according to claim 1, wherein the middle portion of the spoiler elements is offset with respect to at least one of the upper flange portion and the lower flange portion horizontally away from the elevator car.

15. An elevator comprising:

the elevator car according to claim 1.

16. The elevator car according to claim 1, further comprising:

a front spoiler element on a second side of the side portions adjacent to the first side of the side portions, the front spoiler element covering at least a second part of the horizontal frame part, at least a portion of the front spoiler element being below a cabin of the elevator car.

* * * * *